US007837814B2

(12) United States Patent
Minami et al.

(10) Patent No.: US 7,837,814 B2
(45) **Date of Patent: *Nov. 23, 2010**

(54) FINE-FIBERS-DISPERSED NONWOVEN FABRIC, PROCESS AND APPARATUS FOR MANUFACTURING SAME, AND SHEET MATERIAL CONTAINING SAME

(75) Inventors: Akinori Minami, Ibaraki (JP); Masaaki Kawabe, Ibaraki (JP)

(73) Assignee: Japan Vilene Co., Ltd., Tokyo (JP)

( * ) Notice: Subject to any disclaimer, the term of this patent is extended or adjusted under 35 U.S.C. 154(b) by 174 days.

This patent is subject to a terminal disclaimer.

(21) Appl. No.: 11/290,458

(22) Filed: Dec. 1, 2005

(65) Prior Publication Data

US 2006/0081330 A1 Apr. 20, 2006

Related U.S. Application Data

(62) Division of application No. 09/949,078, filed on Sep. 10, 2001, now abandoned.

(30) Foreign Application Priority Data

Sep. 8, 2000 (JP) ..... 2000-272523

(51) Int. Cl.
*D04H 1/72* (2006.01)

(52) U.S. Cl. ..... 156/62.4; 264/115; 264/121; 425/82.1

(58) Field of Classification Search ..... 264/518, 264/115, 116, 121; 425/82.1, 83.1; 156/62.2, 156/62.4, 167, 176, 181, 538; 19/304
See application file for complete search history.

(56) References Cited

U.S. PATENT DOCUMENTS

| | | | | |
|---|---|---|---|---|
| 2,079,094 | A * | 5/1937 | Whitehead et al. | 19/0.56 |
| 2,543,101 | A * | 2/1951 | Francis, Jr. | 442/278 |
| 2,893,889 | A | 7/1959 | Ericson et al. | |
| 3,453,355 | A * | 7/1969 | Rudloff | 264/115 |
| 3,984,054 | A * | 10/1976 | Frochaux | 239/424 |
| 4,100,324 | A | 7/1978 | Anderson et al. | |
| 4,352,649 | A * | 10/1982 | Jacobsen et al. | 425/83.1 |

(Continued)

FOREIGN PATENT DOCUMENTS

EP 1213377 A1 6/2001

(Continued)

OTHER PUBLICATIONS

Patent Abstracts of Japan vol. 1997, No. 02, Feb. 28, 1997 & JP 08 266829 A (Japan Vilene Co Ltd), Oct. 15, 1996 * abstract *.

(Continued)

*Primary Examiner*—Michael A Tolin
(74) *Attorney, Agent, or Firm*—Sughrue Mion, PLLC

(57) ABSTRACT

Disclosed is a fine-fibers-dispersed nonwoven fabric comprising dispersed fine fibers having a fiber diameter of 4 μm or less and a fiber length of 3 mm or less, wherein an adhesion rate of substances adhered to the nonwoven fabric is 0.5 mass % or less. Further, a process and an apparatus for manufacturing the fine-fibers-dispersed nonwoven fabric, as well as a sheet material comprising the fine-fibers-dispersed nonwoven fabric are also disclosed.

8 Claims, 3 Drawing Sheets

U.S. PATENT DOCUMENTS

| | | | | | |
|---|---|---|---|---|---|
| 4,383,349 | A | * | 5/1983 | Marshall | 19/0.56 |
| 4,468,428 | A | * | 8/1984 | Early et al. | 428/221 |
| 4,640,810 | A | * | 2/1987 | Laursen et al. | 264/518 |
| 4,765,547 | A | * | 8/1988 | Marui et al. | 241/40 |
| 5,007,137 | A | * | 4/1991 | Graute | 19/296 |
| 5,254,399 | A | | 10/1993 | Oku et al. | |
| 5,298,315 | A | | 3/1994 | Fukui et al. | |
| 5,778,492 | A | * | 7/1998 | Thiessen et al. | 19/107 |
| 5,954,920 | A | * | 9/1999 | Katayama et al. | 162/157.3 |
| 6,028,018 | A | * | 2/2000 | Amundson et al. | 442/381 |
| 6,187,699 | B1 | | 2/2001 | Terakawa et al. | |

FOREIGN PATENT DOCUMENTS

| | | |
|---|---|---|
| JP | 50-160563 | 12/1975 |
| JP | 59-82423 | 5/1984 |
| JP | 2-132668 | 11/1990 |
| JP | 6-101120 | 4/1994 |

OTHER PUBLICATIONS

Patent Abstracts of Japan vol. 2000, No. 11, Jan. 3, 2001 & JP 2000 212866 A (CHISSO Corp), Aug. 2, 2000) * abstract *.

* cited by examiner

100 μm

100 μm

FINE-FIBERS-DISPERSED NONWOVEN FABRIC, PROCESS AND APPARATUS FOR MANUFACTURING SAME, AND SHEET MATERIAL CONTAINING SAME

CROSS REFERENCE TO RELATED APPLICATION

This is a divisional application of application Ser. No. 09/949,078 filed Sep. 10, 2001 now abandoned; the entire disclosure of prior application Ser. No. 09/949,078 is considered part of the disclosure of this application and is incorporated herein by reference.

BACKGROUND OF THE INVENTION

1. Field of the Invention

The present invention relates to a fine-fibers-dispersed nonwoven fabric, a process and an apparatus for manufacturing the same, as well as a sheet material comprising the same.

2. Description of the Related Art

Many functions can be imparted to a nonwoven fabric by appropriately combining a selection of fibers used, processes for manufacturing a fiber web, and/or processes for bonding a fiber web, and therefore, the nonwoven fabric has wide applications. For example, a nonwoven fabric composed of fine fibers having a fiber diameter of 4 μm or less and a fiber length of 3 mm or less has excellent filtering characteristics, and thus, can be preferably used as a gas or liquid filter. Further, the nonwoven fabric has a good pliability, and thus, can be preferably used as an interlining cloth.

One of the conventional processes for manufacturing such a nonwoven fabric composed of fine fibers having a fiber diameter of 4 μm or less and a fiber length of 3 mm or less comprises the steps of forming a fiber web from islands-in-sea type composite fibers, namely, fibers prepared by dispersing resin components (islands components), difficult to be removed by a particular solvent, into a resin component (sea component) capable of being removed by the particular solvent, in accordance with a carding method or an air-laid method, entangling fibers by an action of needles or a water jet to form an entangled fiber web, and then, removing therefrom the sea components of the islands-in-sea type composite fibers by the solvent to generate the fine fibers of the island components. This process can provide a nonwoven fabric composed of fine fibers having a fiber diameter of 4 μm or less and a fiber length of 3 mm or less. Nevertheless, the fine fibers are present as bundles in the nonwoven fabric, and thus, the nonwoven fabric is not too different from a fabric composed of thick fibers, and therefore, the filtering characteristics or pliability are not sufficient.

There is a known process for manufacturing a nonwoven fabric, which process can remedy the bundles of the fine fibers. The process comprises the steps of taking up fine fibers having a fiber diameter of 4 μm or less and a fiber length of 3 mm or less from a slurry containing dispersed fine fibers, to form a fiber web, and then bonding the fiber web. This process can provide a nonwoven fabric composed of the dispersed fine fibers. Nevertheless, the fiber web formed by taking up the fine fibers from slurry has a high apparent density, because the fine fibers therein are closely bonded with each other. Therefore, when the nonwoven fabric is used as a filter, a pressure loss becomes high.

SUMMARY OF THE INVENTION

Accordingly, the object of the present invention is to remedy the above disadvantages of the prior art, and provide a nonwoven fabric composed of fine fibers dispersed therein, namely, a fine-fibers-dispersed nonwoven fabric, wherein the fine fibers are in contact with each other to a lesser degree.

The inventors of the present invention engaged in intensive research to remedy the above disadvantages of the prior art, and as a result, found the reasons for the high apparent density of the fiber web prepared by taking up from slurry. First, surface-active agents are used to disperse the fine fibers, and/or sizing agents are used to fix the fine fibers to each other. The surface-active agents and/or the sizing agents are adhered on the surfaces of the fine fibers, and the adhered surface-active agents and/or the adhered sizing agents serve to raise a degree of adhesion of the fine fibers. Secondly, when the fiber web is formed by taking up from a slurry, a solvent (such as water) dispersing the fine fibers is removed in such a way that the solvent moves in a direction of thickness of the fiber web. Therefore, the fine fibers are orientated in a direction crossing at right angles to the thickness direction of the fiber web, and are closely adhered to each other. The present invention is based on the above findings.

Other objects and advantages of the present invention will be apparent from the following description.

In accordance with the present invention, there is provided a fine-fibers-dispersed nonwoven fabric comprising fine fibers having a fiber diameter of 4 μm or less and a fiber length of 3 mm or less in a dispersed state, wherein an adhesion rate of substances adhered to the nonwoven fabric is 0.5 mass % or less.

The fine-fibers-dispersed nonwoven fabric of the present invention includes a very small amount of adhered substances, such as the surface-active agents or sizing agents, and thus, the degree of adhesion of the fine fibers is at a lower level. Therefore, the fine-fibers-dispersed nonwoven fabric contains an appropriate amount of voids having an appropriate size, and a pressure loss of the fine-fibers-dispersed nonwoven fabric is small. Further, in the fine-fibers-dispersed nonwoven fabric of the present invention, the fine fibers are not present in the form of bundles but in the dispersed state, and thus, the fine-fibers-dispersed nonwoven fabric has excellent properties, such as filtering characteristics and pliability, due to the containing of the fine fibers. Therefore, the fine-fibers-dispersed nonwoven fabric of the present invention contains an appropriate amount of voids having an appropriate size, exhibits a small pressure loss, and has excellent properties, such as filtering characteristics and pliability, due to the containing of the fine fibers.

In accordance with the present invention, there is provided a, process for manufacturing a fine-fibers-dispersed nonwoven fabric comprising the steps of:

ejecting aggregates of fine fibers having a fiber diameter of 4 μm or less and a fiber length of 3 mm or less, or a group of the aggregates, and/or mechanically dividable fibers capable of generating fine fibers having a fiber diameter of 4 μm or less and a fiber length of 3 mm or less, or aggregates of the mechanically dividable fibers, from a nozzle into a gas by an action of a compressed gas, to thereby divide the aggregates or the group thereof into the fine fibers, and/or divide the mechanically dividable fibers or the aggregates thereof into the fine fibers, and disperse the resulting fine fibers;

collecting the dispersed fine fibers to form a fiber web; and bonding the fiber web to obtain the fine-fibers-dispersed nonwoven fabric.

In the process of the present invention, a solvent as a medium used for dispersing the fine fibers in the conventional process is not required, as the fine fibers are dispersed into a gas, and thus, it is not necessary to use the surface-active agents or sizing agents required in the process using a solvent as a dispersing medium. Therefore, according to the process of the present invention, the nonwoven fabric wherein an adhesion rate of the substances adhered to the fine-fibers-dispersed nonwoven fabric is 0.5 mass % or less, i.e., the nonwoven fabric containing the fine fibers adhered to each other to a lesser degree, can be easily prepared. Further, the nonwoven fabric containing the uniformly dispersed fine fibers can be easily prepared, because the fine-fibers-dispersed nonwoven fabric is prepared by ejecting the fine-fibers aggregates (particularly, the bundled aggregates) or the group thereof, and/or the mechanically dividable fibers or the aggregates thereof, from the nozzle into the gas by an action of the compressed gas, to thereby divide the aggregates or the group thereof into the fine fibers, and/or divide the mechanically dividable fibers or the aggregates thereof into the fine fibers, and disperse the resulting fine fibers.

In accordance with the present invention, there is also provided an apparatus for manufacturing a fine-fibers-dispersed nonwoven fabric comprising (1) a nozzle capable of ejecting aggregates of fine fibers having a fiber diameter of 4 μm or less and a fiber length of 3 mm or less, or a group of the aggregates, and/or mechanically dividable fibers capable of generating fine fibers having a fiber diameter of 4 μm or less and a fiber length of 3 mm or less, or aggregates of the mechanically dividable fibers, into a gas by an action of a compressed gas;
(2) a means for supplying the compressed gas to the nozzle;
(3) a dispersing chamber for dividing the fine-fibers aggregates or the group thereof, and/or the mechanically dividable fibers or the aggregates thereof ejected from the nozzle into a gas by an action of the compressed gas into the fine fibers, and dispersing the fine fibers;
(4) a support on which the fine fibers dispersed in the gas in the dispersing chamber are collected to form a fiber web; and
(5) a thermal fusing means for heating the fiber web on the support.

In accordance with the present invention, there is also provided a sheet material comprising at least one layer of a fine-fibers-dispersed nonwoven fabric layer containing dispersed fine fibers having a fiber diameter of 4 μm or less and a fiber length of 3 mm or less, wherein an adhesion rate of substances adhered to the nonwoven fabric layer is 0.5 mass % or less.

The sheet material of the present invention contains the layer of the fine-fibers-dispersed nonwoven fabric (hereinafter referred to as the fine-fibers-dispersed nonwoven fabric layer), and therefore, the fine-fibers-dispersed nonwoven fabric layer includes a very small amount of adhered substances, such as the surface-active agents or sizing agents, and thus, the degree of adhesion of the fine fibers in the fine-fibers-dispersed nonwoven fabric layer is at a lower level. Therefore, the fine-fibers-dispersed nonwoven fabric layer contains an appropriate amount of voids having an appropriate size, and a pressure loss of the fine-fibers-dispersed nonwoven fabric layer is small. Further, in the fine-fibers-dispersed nonwoven fabric layer, the fine fibers are not present in the form of bundles but in the dispersed state, and thus, the fine-fibers-dispersed nonwoven fabric layer has excellent properties, such as filtering characteristics and pliability, due to the containing of the fine fibers. Therefore, the sheet material of the present invention contains an appropriate amount of voids having an appropriate size, exhibits a small pressure loss, and has excellent properties, such as filtering characteristics and pliability, due to the containing of the fine fibers.

DESCRIPTION OF THE PREFERRED EMBODIMENTS

Figure 1:
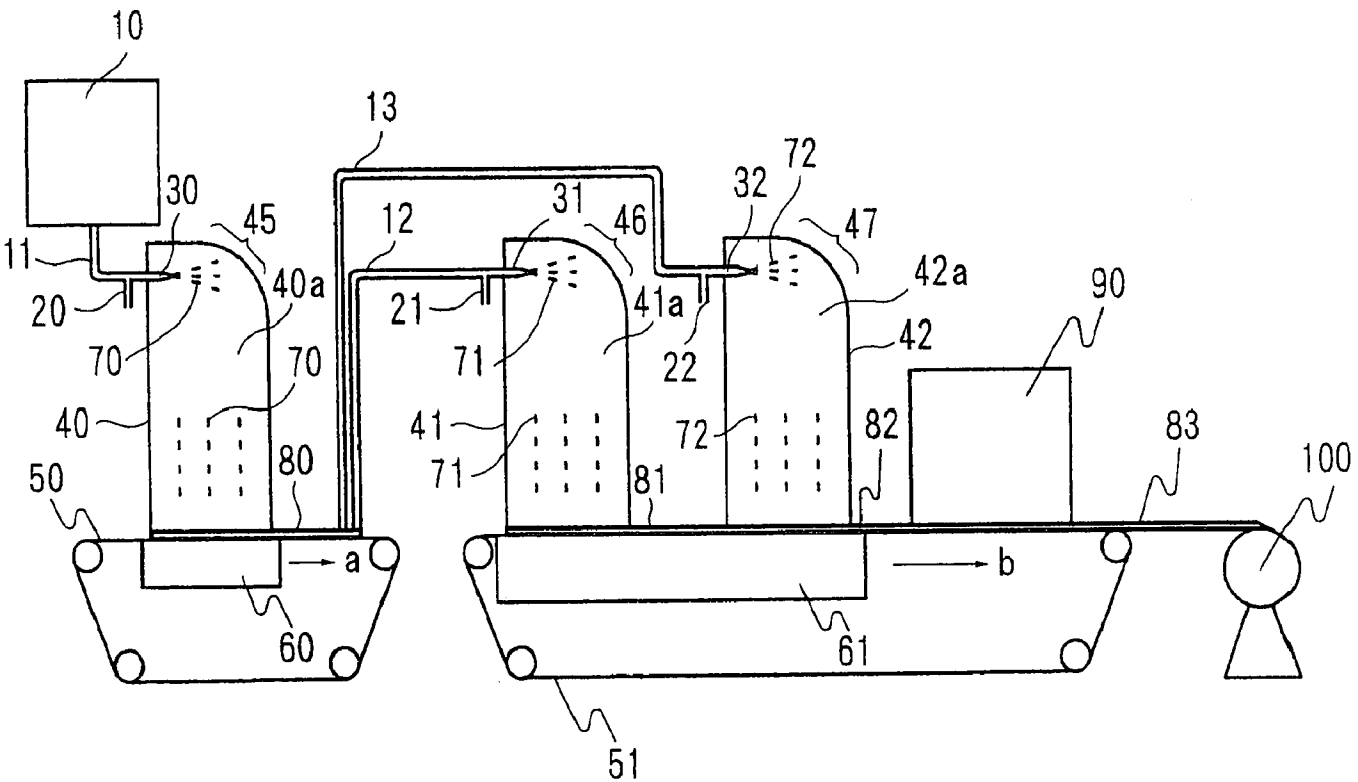
FIG. 1 schematically illustrates an embodiment of the apparatus for manufacturing the fine-fibers-dispersed nonwoven fabric of the present invention.

The fine-fibers-dispersed nonwoven fabric of the present invention contains fine fibers having a fiber diameter of 4 μm or less and a fiber length of 3 mm or less, so that excellent properties, such as filtering characteristics or pliability, are exhibited. When the fine-fibers-dispersed nonwoven fabric of the present invention contains the fine fibers having a smaller fiber diameter, the nonwoven fabric exhibits more excellent properties. Therefore, the fiber diameter is preferably 3 μm or less, more preferably 2 μm or less. In general, fibers having a smaller fiber diameter become more pliable, and fine fibers are easily entangled with each other. Thus, it would be more difficult to uniformly disperse such fine fibers, and thus to obtain advantages due to the containing of the fine fibers. On the contrary, the fine fibers in the fine-fibers-dispersed nonwoven fabric of the present invention are uniformly dispersed, and therefore, the above properties are improved, with the fiber diameter of the fine fibers becoming smaller. There is no particular lower limit of the fiber diameter of the fine fibers, but about 0.01 μm is appropriate.

The term "fiber diameter" as used herein with respect to a fiber having a circular cross-sectional shape means a diameter of the circle. For a fiber having a non-circular cross-sectional shape, a diameter of a circle having an area the same as that of the non-circular cross-sectional shape is regarded as the diameter.

The fine fibers forming the fine-fibers-dispersed nonwoven fabric of the present invention have a fiber length of 3 mm or less so that the fine fibers exhibit an excellent dispersibility. If the fine fibers have a fiber length of more than 3 mm, a degree of freedom thereof and the dispersibility become lowered. The fiber length is preferably 2 mm or less. The lower limit of the fiber length of the fine fiber is not particularly limited, but is appropriately about 0.1 mm. The fine fibers cut into a fiber length of 3 mm or less in such a way that they have a uniform fiber length are preferable.

The term "fiber length" as used herein means a value measured in accordance with JIS L 1015 (a testing method for man-made staple fibers), the B method (an amended method for staple diagram).

The fine fibers used in the present invention may be prepared from any material, such as an organic or inorganic material, for example, an organic material, such as polyamide based resin, polyvinyl alcohol based resin, polyvinylidene chloride based resin, polyvinyl chloride based resin, polyester based resin, polyacrylonitrile based resin, polyolefin based resin (such as polyethylene based resin, or polypropylene based resin), polystyrene based resin (such as crystalline polystyrene, or amorphous polystyrene), aromatic polyamide based resin, or polyurethane based resin; or an inorganic material, for example, glass, carbon, potassium titanate, silicon carbide, silicon nitride, zinc oxide, aluminum borate, or Wollastonite.

In general, the fine fibers made of one or more organic materials have a rigidity lower than that of the fine fibers made of inorganic materials, and thus are softer than the latter. The former fine fibers are easily entangled with each other, and therefore, it is more difficult to uniformly disperse the former fine fibers, and thus to obtain advantages due to the containing of the fine fibers. On the contrary, the fine fibers in the fine-fibers-dispersed nonwoven fabric of the present invention are uniformly dispersed, and therefore, properties due to the containing of the fine fibers made of organic materials, such as bulkiness, hand and feel, and elasticity, are improved.

The fibers contained in the fine-fibers-dispersed nonwoven fabric of the present invention must be bonded with each other to maintain the shape of the nonwoven fabric. Preferably, the fine fibers are fusible, because the shape of the nonwoven fabric can be maintained by the fusion of the fine fibers, and the fine fibers are rarely dropped. The fusible fine fiber may be a fiber containing a thermoplastic resin on at least a part of the surface of the fine fiber. The material for the surface of the fine fiber may be, for example, a crystalline thermoplastic resin, such as a polyolefin based resin (such as polyethylene based resin, or polypropylene based resin), polyvinylidene chloride based resin, polyester based resin, polyamide based resin, crystalline polystyrene; or an amorphous thermoplastic resin, such as polyvinyl chloride based resin, amorphous polystyrene based resin, polyacrylonitrile based resin, or polyvinyl alcohol based resin.

Preferably, the fine fiber is composed of two or more components having a melting point different from each other, because a form or shape of the fine fiber may be maintained due to the presence of at least one non-fusible component. When the fine fiber is a composite fiber composed of two or more components, the cross-sectional shape may be, for example, a sheath-core type, an eccentric type, an islands-in-sea type, a side-by-side type, a multiple bimetal type, or an orange type.

Preferably, each of the fine fibers has a diameter that does not substantially change in an axial direction of the fiber, namely, has substantially the same diameter, so that the fine-fibers-dispersed nonwoven fabric has an excellent uniformity. The fine fibers having substantially the same diameter that does not substantially change in an axial direction of the fiber may be prepared, for example, by removing sea components from islands-in-sea type fibers obtained by a composite spinning method, such as a method for extruding and compositing island components into sea components under the condition that a spinning nozzle is controlled. In general, the fine fibers prepared by removing sea components from islands-in-sea type fibers are liable to form bundled aggregates of the fine fibers derived from island components, to be in close contact with each other, and easily entangled with each other. Therefore, it would be difficult to uniformly disperse such fine fibers, and thus to obtain advantages due to the containing of the fine fibers. On the contrary, even in the form of bundled aggregates the fine fibers can be uniformly dispersed in the fine-fibers-dispersed nonwoven fabric of the present invention, and therefore, properties due to the containing of the fine fibers are obtained. Further, bundled aggregates of the fine fibers prepared by removing sea components from islands-in-sea type fibers are liable to be cohered, and thus, it would be difficult to uniformly disperse such fine fibers. On the contrary, even in the form of the bundled aggregates the fine fibers can be uniformly dispersed in the fine-fibers-dispersed nonwoven fabric of the present invention, and therefore, properties due to the containing of the fine fibers are obtained.

The fine fibers used in the present invention may be undrawn, but preferably are drawn, because a good mechanical strength is thus obtained.

As above, the fine fibers are dispersed in the fine-fibers-dispersed nonwoven fabric of the present invention, and thus, the properties due to the containing of the fine fibers can be obtained. An amount of the fine fibers contained in the fine-fibers-dispersed nonwoven fabric is preferably 20 mass % or more, more preferably 50 mass % or more, most preferably 100 mass %, so that the properties due to the containing of the fine fibers can be obtained.

The fine-fibers-dispersed nonwoven fabric of the present invention may contain, in addition to the fine fibers defined as above, (1) fibers having a fiber diameter of more than 4 μm and a fiber length of 3 mm or less, hereinafter referred to as thick fibers, (2) fibers having a fiber diameter of 4 μm or less and a fiber length of more than 3 mm, hereinafter referred to as long fibers, or (3) fibers having a fiber diameter of more than 4 μm and a fiber length of more than 3 mm, hereinafter referred to as thick-long fibers. Of these fibers, the long fibers and the thick-long fibers having a fiber length of more than 3 mm exhibit a poor dispersibility, and may affect the dispersibility of the fine fibers. Thus, it is preferable to use the thick fibers having a fiber length of 3 mm or less.

The upper limit of the fiber diameter of the thick fiber used is not particularly limited, but is appropriately about 50 μm, because the uniformity of the fine-fibers-dispersed nonwoven fabric may be affected when the fiber diameter of the thick fibers is too thick in comparison with the fiber diameter of the fine fibers.

The thick fibers have a fiber length of preferably 2 mm or less, so as to have an excellent dispersibility. The lower limit of the fiber length of the thick fiber is not particularly limited, but is appropriately about 0.1 mm. The thick fibers, which are cut into a fiber length of 3 mm or less in such a way that they have a uniform fiber length, are preferable.

As the fine fibers, the thick fibers may be prepared from any material, such as an organic or inorganic material, for example, an organic material, such as polyamide based resin, polyvinyl alcohol based resin, polyvinylidene chloride based resin, polyvinyl chloride based resin, polyester based resin, polyacrylonitrile based resin, polyolefin based resin (such as polyethylene based resin, or polypropylene based resin), polystyrene based resin (such as crystalline polystyrene, or amorphous polystyrene), aromatic polyamide based resin, or polyurethane based resin; or an inorganic material, for example, glass, carbon, potassium titanate, silicon carbide, silicon nitride, zinc oxide, aluminum borate, or Wollastonite.

When the thick fibers are fusible, the shape of fine-fibers-dispersed nonwoven fabric of the present invention can be maintained by the fusion of the thick fibers. The fusible thick fiber may be a fiber containing a thermoplastic resin on at least a part of the surface of the thick fiber. The material for the surface of the thick fiber may be, for example, a crystalline thermoplastic resin, such as polyolefin based resin (such as polyethylene based resin, or polypropylene based resin), polyvinylidene chloride based resin, polyester based resin, polyamide based resin, crystalline polystyrene; or an amorphous thermoplastic resin, such as polyvinyl chloride based resin, amorphous polystyrene based resin, polyacrylonitrile based resin, or polyvinyl alcohol based resin.

Preferably, the thick fiber is composed of two or more components having a melting point different from each other, because a form or shape of the thick fiber may be maintained due to the presence of at least one non-fusible component, when one of the components is fused. When the thick fiber is a composite fiber composed of two or more components, the cross-sectional shape may be, for example, a sheath-core type, an eccentric type, an islands-in-sea type, a side-by-side type, a multiple bimetal type, or an orange type.

The thick fibers may be undrawn, but preferably are drawn because a good mechanical strength is thus obtained.

As above, the fine fibers are dispersed in the fine-fibers-dispersed nonwoven fabric of the present invention, and thus, the properties due to the containing of the fine fibers can be obtained. That is, the fine fibers are not present in the form of bundles, and thus, the properties due to the containing of the fine fibers can be obtained.

In the fine-fibers-dispersed nonwoven fabric of the present invention, an adhesion rate of substances (such as surface-active agents or sizing agents) adhered to the fine-fibers-dispersed nonwoven fabric is as low as 0.5 mass % or less, so as to prevent the fine fibers therein from closely adhering to each other. The above advantageous effect can be enhanced as the adhesion rate is lowered. Therefore, the adhesion rate is preferably 0.3 mass % or less, more preferably 0.1 mass % or less, still more preferably 0.08 mass % or less, still more preferably 0.06 mass % or less, still further more preferably 0.04 mass % or less, most preferably 0.02 mass % or less.

The adhesion rate of the adhered substances is very low in the fine-fibers-dispersed nonwoven fabric of the present invention, and the possibility of a dropping of the adhered substances from the fine-fibers-dispersed nonwoven fabric becomes very low when the fine-fibers-dispersed nonwoven fabric is used. This can provide various effects. For example, although a conventional nonwoven fabric may be used as a filter for physically adsorbing and removing dust materials contained in a fluid to be treated, the filter per se, i.e., the conventional nonwoven fabric per se, generally generates pollutants, and its role as a filter is deteriorated. On the contrary, in the fine-fibers-dispersed nonwoven fabric of the present invention or the sheet material containing at least one fine-fibers-dispersed nonwoven fabric layer of the present invention, the adhered substances are present in a small amount. Therefore, the possibility of the dropping of the adhered substances is very low, and the fine-fibers-dispersed nonwoven fabric of the present invention or the sheet material of the present invention may be preferably used as a filter.

The adhesion rate of the adhered substances means a percentage of a mass of the adhered substances to a mass of the fine-fibers-dispersed nonwoven fabric, namely, a value calculated from the equation (1):

$$A=(ms/mf)\times 100 \quad (1)$$

wherein A denotes the adhesion rate (%), ms denotes a mass (g) of the adhered substances, and mf denotes a mass (g) of the fine-fibers-dispersed nonwoven fabric.

It is difficult to lower an adhesion rate of adhered substances to a level of 0.5 mass % or less by forming a fiber web by, for example, a wet-laid method, from the fine fibers used in the present invention, using surface-active agents or sizing agents, and then treating the web with a water jet.

The term "adhered substances" as used herein includes an extract (hereinafter referred to as a hot-water extract) obtained by dipping the fine-fibers-dispersed nonwoven fabric in hot water at, for example, 80 to 100° C. for 15 minutes; and an extract (hereinafter referred to as a hot-methanol extract) obtained by dipping the fine-fibers-dispersed nonwoven fabric in hot methanol for 15 minutes. The hot-water extract is, for example, a sizing agent, such as acrylamide, sodium polyacrylate, sodium polyalginate, polyethylene oxide, methyl cellulose, carboxymethylcellulose, hydroxymethylcellulose, or polyvinyl alcohol. The hot-methanol extract is, for example, a surface-active agent, i.e., a compound having one or more hydrophilic groups and one or more lipophilic groups, such as a nonionic surface-active agent.

The fine-fibers-dispersed nonwoven fabric of the present invention may be a unilayered fabric or contain two or more fine-fibers-dispersed layers. When the fabric contains two or more fine-fibers-dispersed layers, various characteristics may be imparted. For example, filtering characteristics may be enhanced if the fabric contains two or more fine-fibers-dispersed layers, the contents of the fine fibers therein being different from each other.

The fibers, such as the fine fibers and thick fibers, forming the fine-fibers-dispersed nonwoven fabric of the present invention are bonded preferably by a fusion of the fibers, such as the fine fibers and thick fibers. This is because, when the fibers (such as the fine fibers and thick fibers) are bonded by fusion, the fine-fibers-dispersed nonwoven fabric is bonded without disturbing the arrangement of the fine fibers, the fine fibers are not closely adhered, and the fine-fibers-dispersed nonwoven fabric contains an appropriate amount of voids having an appropriate size. Further, it is preferable that the fine fibers are not entangled, because the fine fibers are liable to be closely adhered if entangled.

The fine-fibers-dispersed nonwoven fabric of the present invention may be composed only of the layer containing the dispersed fine fibers, but the strength of such a fabric is liable to be weak, and thus, the fine-fibers-dispersed nonwoven fabric of the present invention may contain one or more reinforcing layers, to enhance the strength. Materials forming the reinforcing layer are, for example, threads, a net, a woven fabric, a knitted fabric, a fiber web, or a usual nonwoven fabric.

An apparent density of the fine-fibers-dispersed nonwoven fabric of the present invention can be as low as 0.005 g/cm$^3$, because the fine fibers are not closely adhered to each other. The apparent density of the fine-fibers-dispersed nonwoven fabric of the present invention may be about 0.005 to 0.1 g/cm$^3$.

The term "apparent density" as used herein means a value calculated by dividing a mass per unit area (g/cm$^2$) by a thickness (cm). The thickness is measured when no load is applied. The mass per unit area is measured by a method disclosed in Japanese Industrial Standards (JIS) L1085: 1998, 6.2.

The fine-fibers-dispersed nonwoven fabric of the present invention has an excellent uniformity, and the mass per unit area of the fine-fibers-dispersed nonwoven fabric of the present invention can be as low as 1 g/m$^2$. The mass per unit area of the fine-fibers-dispersed nonwoven fabric of the present invention can be about 1 to 100 g/m$^2$.

The fine-fibers-dispersed nonwoven fabric of the present invention contains the fine fibers, and exhibits various excellent characteristics, such as filtering characteristics, pliability, wiping-off capacity, and/or opacifying properties. Therefore, the fine-fibers-dispersed nonwoven fabric of the present invention, or the sheet material containing at least one fine-fibers-dispersed nonwoven fabric layer of the present invention, may be used in many applications, for example, as a gas or liquid filter (such as a HEPA filter, a bag filter, or a cartridge filter), a substrate for a deodorizing filter, a substrate for a mask (such as a surgical operation mask or an industrial mask), a filter press, a drape for a surgical operation, a gown for a surgical operation, a diaper cover, a battery separator, or a water absorption sheet (for example, for a moistening device).

The fine-fibers-dispersed nonwoven fabric of the present invention may be produced by, for example, the following method.

In the first place, the aggregates (particularly, bundled aggregates) of fine fibers having a fiber diameter of 4 μm or less and a fiber length of 3 mm or less, or a group of the aggregates (particularly, the bundled group of the bundled aggregates), and/or mechanically dividable fibers capable of generating fine fibers having a fiber diameter of 4 μm or less and a fiber length of 3 mm or less, or aggregates (particularly, bundled aggregates) of the mechanically dividable fibers are prepared. When the adhesion rate of the substances adhered to the fine-fibers aggregates or the group thereof, and/or the mechanically dividable fibers or the aggregates thereof is 0.5 mass % or less (preferably 0.3 mass % or less, more preferably 0.1 mass % or less, still more preferably 0.08 mass % or less, still more preferably 0.06 mass % or less, still more preferably 0.04 mass % or less, most preferably 0.02 mass % or less), the fine-fibers-dispersed nonwoven fabric of the present invention may be easily produced.

The fine-fibers aggregates with a low adhesion rate or the group thereof with a low adhesion rate, or the mechanically dividable fibers with a low adhesion rate or the aggregates thereof with a low adhesion rate may be prepared, for example, by washing commercially available fine-fibers aggregates or the group thereof, or the mechanically dividable fibers or the aggregates thereof with a solvent such as acetone to a level of 0.5 mass % or less with respect to the adhesion rate. Alternatively, the fine-fibers aggregates with a low adhesion rate or the group thereof with a low adhesion rate may be prepared, for example, by extracting and removing sea component from islands-in-sea type fibers obtained by a composite spinning method or a melt blend spinning method or the group thereof. Further, the adhesion rate of the resulting aggregates or the group thereof may be lowered by washing with a solvent such as acetone after extracting and removing the sea component from the islands-in-sea type fibers. When the adhered substances are removed, static electrical charges are prone to be generated on the surfaces of the fine fibers, and the fine fibers are easily dispersed due to an electrical repulsion between the fine fibers.

When the fine fibers in the fine-fibers-aggregates or the group thereof used are in an entangled state, a uniform dispersion of the fine fibers would become difficult even by an action of a compressed gas as mentioned below, or the fine fibers must be treated with the compressed gas many times. Therefore, it is preferable to use the aggregates wherein the fine fibers are not entangled, or the group of such aggregates. For example, it is preferable not to use fine fibers aggregates prepared by beating mechanically dividable fibers by a beater, pulps beaten by a beater, or fine fibers aggregates prepared by a flash spinning method, because the fine fibers are entangled to each other. Further, it is possible to use the mechanically dividable fibers capable of generating fine fibers having a fiber diameter of 4 μm or less and a fiber length of 3 mm or less by an action of the compressed gas, or aggregates of the mechanically dividable fibers, such as whole aromatic polyamide fine fibers or the aggregates thereof, or cellulose fibers prepared by a solvent extraction method, or the aggregates thereof. Furthermore, it is preferable that the thick fibers or the aggregates thereof used are washed with acetone or the like to prepare the thick fibers or the aggregates thereof with a lower adhesion rate.

Thereafter, the fine-fibers aggregates or the group thereof, and/or the mechanically dividable fibers or the aggregates thereof, and optionally the thick fibers or the aggregates thereof, are supplied to a nozzle while an action of the compressed gas is applied to the fine-fibers aggregates or the group thereof, and/or the mechanically dividable fibers or the aggregates thereof, and optionally the thick fibers or the aggregates thereof, so that they are ejected from the nozzle to a gas to thereby divide and disperse the fine fibers from the fine-fibers aggregates or the group thereof, and/or divide the mechanically dividable fibers or the aggregates thereof into the fine fibers, and dispersing the resulting fine fibers. When the thick fibers or the aggregates thereof are used, they are supplied to a nozzle to thereby disperse the thick fibers, or divide and disperse the thick fibers from the aggregates.

Preferably, the gas stream passing through the nozzle is substantially a laminar flow. When the gas stream passing through the nozzle is substantially a laminar flow, the fine fibers are rarely entangled, and thus are easily dispersed. In general, the fine fibers passed through the nozzle are prone to be entangled, if the fiber diameter of the fine fibers passed through the nozzle is as thin as 4 μm or less, particularly 2 μm or less, and thus have a low rigidity, i.e., high pliability, the fine fibers are in the form of the bundled aggregates or the group of the bundled aggregates, particularly, the bundled aggregates derived from the island components of the islands-in-sea type fibers, particularly the group of such bundled aggregates, or the fine fibers are composed of the organic materials, and thus have a low rigidity, i.e., a high pliability. Nevertheless, the entanglement of such fine fibers may be inhibited, using the gas stream in the form of a substantially laminar flow. The substantially laminar flow may be generated by using a Venturi tube as the nozzle.

The nozzle may have a constant cross-sectional area in a direction of flow from the supplier to the ejecting opening. Alternatively, the cross-sectional area may be continuously or discontinuously increased or decreased in the direction of flow; or continuously or discontinuously increased and then decreased, or continuously or discontinuously decreased and then increased in the direction of flow. Further, the ejected fine-fibers aggregates or the group thereof, and/or the ejected mechanically dividable fibers or the aggregates thereof may be brought into collision with a colliding means, such as a baffle plate, placed in front of the nozzle, to enhance the generating rate of the fine fibers from the fine-fibers aggregates or the group thereof, and/or the mechanically dividable fibers or the aggregates thereof, and the dispersibility of the resulting fine fibers. When the gas stream passing through the nozzle is a substantially laminar flow, it is preferable to use the colliding means, such as the baffle plate, for promoting the dispersion, because the laminar flow has a poor action in the division and dispersal of the fine fibers.

Any gas may be used as the compressed gas, and a compressed air may be preferably used for the production of the fine-fibers-dispersed nonwoven fabric. A passing rate of the compressed gas at the ejecting opening of the nozzle is preferably 100 m/sec or more, so that the compressed gas can sufficiently generate the fine fibers from the bundled aggregates of the fine fibers, or the groups of the bundled aggregates, and disperse the resulting fine fibers, and/or sufficiently divide the mechanically dividable fibers or the aggregates thereof into the fine fibers, and disperse the resulting fine fibers. The gas passing rate is a value calculated by dividing a flowing amount ($m^3$/sec) under 1 atmosphere of the gas ejected from the nozzle by a cross-sectional area ($m^2$) of the ejecting opening of the nozzle. A pressure of the compressed gas is preferably 2 kg/$cm^2$ or more, so that the compressed gas can sufficiently generate the fine fibers from the bundled aggregates of the fine fibers or the group of the bundled aggregates, and disperse the resulting fine fibers, and/or sufficiently divide the mechanically dividable fibers or the aggregates thereof into the fine fibers, and disperse the resulting fine fibers.

The gas as a dispersing medium in which the fine-fibers aggregates or the group thereof ejected from the nozzle are dispersed, and/or the mechanically dividable fibers or the aggregates thereof ejected from the nozzle are divided and dispersed is not particularly limited, but preferably is an air in view of the production of the fine-fibers-dispersed nonwoven fabric.

When the adhesion rate of the substrates adhered to the fine-fibers aggregates or the group thereof, and/or the mechanically dividable fibers or the aggregates thereof is low, static electrical charges are prone to be generated by a friction between the nozzle and the fine-fibers aggregates or the group thereof, and/or the mechanically dividable fibers or the aggregates thereof. Therefore, the fine fibers repel each other, and may be collected under the condition that the fine fibers are not easily closely adhered to each other.

Then, the dispersed fine fibers, and optionally thick fibers, are collected to form a fiber web. The fine fibers may be collected on a support such as a perforated roll or a net. The fine fibers may be collected by allowing to fall due to gravity-drop or by forcing the drop by use of a suction from a position under the support. In the latter case, a strong suction results in a close adhesion of the fine fibers as the fine fibers are taken up from the slurry, and therefore, the suction must be appropriately adjusted.

Subsequently, the fibers in the fiber web is bonded to form the fine-fibers-dispersed nonwoven fabric. The bonding method is not particularly limited, but for example, a method for fusing fibers (i.e., the fine fibers and/or the thick fibers), a method for adhering the fibers with a binder such as emulsion or latex, or a method for entangling the fibers with a fluid jet such as a water jet, or a combination thereof may be used. Of these methods, the method for fusing the fibers is preferable, because the fine fibers can be bonded to each other while maintaining a state in which they are not closely adhered. It is preferable not to use the method for entangling the fibers with the fluid jet such as the water jet, because the fine fibers are prone to be closely adhered due to a pressure of the fluid jet.

In addition to the basic process for manufacturing the fine-fibers-dispersed nonwoven fabric of the present invention as above, it is preferable that, prior to the ejection of the fine-fibers aggregates or the group thereof, and/or the aggregates of the mechanically dividable fibers from the nozzle by the action of the compressed gas, the fine-fibers aggregates or the group thereof are separated into smaller aggregates or the group thereof, and/or the aggregates of the mechanically dividable fibers are separated into smaller aggregates, or dispersed, mixed in a mixer or the like, to facilitate the uniform dispersion.

Further, after the formation of the fiber web on the support and before the bonding of the fiber web, the fiber web collected on the support may be supplemented again to one or more nozzles, and the fine fibers re-ejected from one or more nozzles, re-dispersed in the gases, and re-collected on one or more supports to form a fiber web. Such a procedure may be repeated.

It is possible to use jointly the fine-fibers aggregates or the group thereof, and/or the mechanically dividable fibers or the aggregates thereof so that the resulting fine-fibers-dispersed nonwoven fabric contains two or more kinds of fine fibers having different fiber diameters. Further, the fine-fibers aggregates or the group thereof containing two or more kinds of fibers different from each other with respect to a fiber diameter, the mechanically dividable fibers or the aggregates thereof containing two or more kinds of fibers different from each other with respect to a fiber diameter, and/or the thick fibers or the aggregates thereof containing two or more kinds of fibers different from each other with respect to a fiber diameter may be supplemented to the nozzle while continuously or discontinuously varying a composition thereof, so that the fine-fibers-dispersed nonwoven fabric containing layers or regions having various apparent densities in a thickness direction of the nonwoven fabric may be prepared.

When collecting the dispersed fine fibers to form the fiber web, the fine fibers may be collected on a reinforcing material such as threads, a net, a woven fabric, a knitted fabric, a fiber web, or a usual nonwoven fabric, to form a laminate. The fine-fibers-dispersed nonwoven fabric of the present invention may be enhanced with respect to the strength by forming the above laminate, and thus, may be used in applications to which a strength is required. Alternatively, the laminate can be produced by forming the fine-fibers-dispersed nonwoven fabric of the present invention and then laminating the resulting fine-fibers-dispersed nonwoven fabric and a reinforcing material such as threads, a net, a woven fabric, a knitted fabric, a fiber web, a usual nonwoven fabric, or a film, to obtain the above advantages.

After the formation of the fine-fibers-dispersed nonwoven fabric of the present invention, the nonwoven fabric may be treated, for example, electrostatically charged. Further, a water repellency or hydrophilicity may be imparted.

The apparatus for manufacturing the fine-fibers-dispersed nonwoven fabric of the present invention will be described hereinafter referring to FIG. 1 schematically illustrating an embodiment thereof. In this connection, the apparatus will be explained when the aggregates (particularly, the bundled aggregates) of fine fibers having a fiber diameter of 4 μm or less and a fiber length of 3 mm or less are used.

The fine fibers having a fiber diameter of 4 μm or less and a fiber length of 3 mm or less are incorporated into a mixing apparatus (such as a mixer) 10 in the form of the bundled aggregates of the fine fibers aggregates, optionally together with the thick fibers or the aggregates thereof. In the mixing apparatus 10, the bundled aggregates are divided into smaller bundled aggregates, or the fine fibers are dispersed, loosened, or mixed.

The loosened or mixed fine fibers and/or bundled aggregates (and optionally the thick fibers and/or the aggregates thereof) are supplied from the mixing apparatus 10 via a supplying tube 11 to a nozzle 30. An appropriate conveying gas from a conveying-gas supplying apparatus (not shown) placed on the mixing apparatus 10 may be used. A compressed gas is introduced from a compressed-gas inlet 20 into the supplying tube 11 at an inside position from and near to the nozzle 30. By an action of the compressed gas, bundled aggregates (and optionally the thick fibers and/or the aggregates thereof) are conveyed from the mixing apparatus 10 via the supplying tube 11 to the nozzle 30, and vigorously ejected from the nozzle 30 into a gas 40*a* in a dispersing chamber 40. Upon the ejection into the gas 40*a*, and the fine fibers 70 are generated from the bundled aggregates and dispersed in the dispersing chamber 40, by an interaction of a difference of an atmospheric pressure in the nozzle 30 and that in the gas 40*a*, and a turbulent flow formed between the ejected compressed gas and the gas 40*a*. Further, the dispersion of the fine fibers 70 ejected from the nozzle 30 is facilitated by bringing the fine fibers 70 into collision with a wall 45 of the dispersing chamber 40. The wall 45 serves as a colliding means. Further, a colliding means, such as a baffle plate, can be located between the ejecting opening of the nozzle 30 and the wall 45. A distance between the ejecting opening of the nozzle 30 and a flat region in the colliding means to be used for the colliding is preferably 1 to 100 mm, more preferably 5 to 40 mm, still more preferably 5 to 30 mm, still more preferably 10 to 30 mm, most preferably 10 to 20 mm.

The fine fibers 70 dispersed in the gas 40*a* in the dispersing chamber 40 fall down in the dispersing chamber 40 and are collected on a support 50 of a net mounted on a bottom of the dispersing chamber 40 to form a fiber web 80. In the apparatus for manufacturing the fine-fibers-dispersed nonwoven fabric of the present invention as shown in FIG. 1, a gas suction apparatus 60 can be placed under the support 50 mounted on the bottom of the dispersing chamber 40 to suck the gas 40*a* in the dispersing chamber 40 and facilitate the collection of the fine fibers 70. The inside of the dispersing chamber 40 may be or may not be hermetically sealed from the outside.

The support 50 for collecting the fiber web 80 thereon is a rotating endless belt which conveys the fiber web 80 to supplying tubes 12, 13 in a direction of an arrow a in FIG. 1. Then, the fiber web 80 is similarly supplied via supplying tubes 12, 13 to nozzles 31, 32. The fiber web may be re-supplied to two nozzles as shown in FIG. 1, or to one nozzle or three or more nozzles. Alternatively, when a sufficient dispersion is achieved, the fiber web may be directly conveyed to a thermal fusing apparatus 90 as mentioned below.

A compressed gas is also introduced from compressed-gas inlets 21, 22 into each of the supplying tubes 12, 13 at an inside position from and near to each of the nozzles 31, 32. By an action of the compressed gases, the fine fibers (and optionally the thick fibers) supplied from the fiber web 80 are conveyed via the supplying tubes 12, 13 to the nozzles 31, 32, and vigorously ejected from the nozzles 31, 32 into gases 41*a*, 42*a* in dispersing chambers 41, 42, respectively. Upon the ejections, the fine fibers 71, 72 are dispersed, respectively. Further, the dispersion of each of the fine fibers 71, 72 ejected from the nozzles 31, 32 is facilitated by bringing the fine fibers 71, 72 into collision with walls 46, 47 of the dispersing chambers 41, 42, respectively. The walls 46, 47 serve as a colliding means. Further, colliding means can be located between the ejecting openings of the nozzles 31, 32 and the walls 46, 47.

The fine fibers 71, 72 dispersed in the gases 41*a*, 42*a* in the dispersing chambers 41, 42 fall down in the dispersing chambers 41, 42, respectively and are collected on a support 51 of a net mounted on the bottoms of the dispersing chambers 41, 42. More particularly, the fine fibers 71 dispersed in the gas 41*a* in the dispersing chamber 41 fall down in the dispersing chamber 41 and are collected on the support 51 to form a unilayered fiber web 81. Then, the unilayered fiber web 81 is conveyed by a rotating endless belt support 51 to the dispersing chamber 42 in a direction of an arrow b in FIG. 1. The fine fibers 72 dispersed in the gas 42*a* in the dispersing chamber 42 fall down in the dispersing chamber 42 and are collected on the unilayered fiber web 81 carried on the support 51 to form a laminated fiber web 82. The resulting laminated fiber web 82 does not have a clear bi-layered structure, because the fine fibers of the unilayered fiber web 80 are re-dispersed.

In the apparatus for manufacturing the fine-fibers-dispersed nonwoven fabric of the present invention as shown in FIG. 1, a gas suction apparatus 61 can be placed under the support 51 which is mounted on the bottoms of the dispersing chambers 41, 42 to suck the gases 41*a*, 42*a* in the dispersing chambers 41, 42 and facilitate the collection of the fine fibers 71, 72. The support 51 and the gas suction apparatus 61 can be placed for a plurality of dispersing chambers as shown in FIG. 1, but may be placed for each of a plurality of dispersing chambers, respectively.

Thereafter, the laminated fiber web 82 is conveyed by the endless belt support 51 to the thermal fusing apparatus 90 where the fine fibers, and optionally the thick fibers, are fused by an action of heat to form a heat-fused nonwoven fabric 83. The resulting heat-fused nonwoven fabric 83 is reeled up on a reeling machine 100.

The sheet material of the present invention comprises at least one layer of the above-mentioned fine-fibers-dispersed nonwoven fabric. That is, the sheet material of the present invention may be a unilayered sheet composed only of the above-mentioned fine-fibers-dispersed nonwoven fabric layer, or may contain one or more layers of the above-mentioned fine-fibers-dispersed nonwoven fabric, and one or more reinforcing layers. The reinforcing layer may be, for example, a thread layer, a net layer, a woven fabric layer, a knitted fabric layer, a fiber web layer, or a usual nonwoven fabric layer. The laminate of the fine-fibers-dispersed nonwoven fabric layer and the reinforcing layer may be produced, for example, by collecting the fine-fibers-dispersed fiber web on the reinforcing layer, and then bonding the fiber web with the reinforcing layer, or by bonding the fine-fibers-dispersed nonwoven fabric layer and the reinforcing layer by an appropriate bonding means.

The sheet material of the present invention contains the fine-fibers-dispersed nonwoven fabric layer, and exhibits various excellent characteristics, such as filtering characteristics, pliability, wiping-off capacity, and/or opacifying properties. Therefore, the sheet material of the present invention may be used in many applications, for example, as a gas or liquid filter (such as a HEPA filter, a bag filter, or a cartridge filter), a substrate for a deodorizing filter, a substrate for a mask (such as a surgical operation mask or an industrial mask), a filter press, a drape for a surgical operation, a gown for a surgical operation, a diaper cover, a battery separator, or a water absorption sheet (for example, for a moistening device).

EXAMPLES

The present invention will now be further illustrated by, but is by no means limited to, the following Examples.

Example 1

Islands-in-sea type fibers (fineness=1.7 dtex) having 25 island components of high-density polyethylene and polypropylene in a sea component of polylactic acid were prepared by a composite spinning method, and cut to a fiber length of 1 mm. The resulting islands-in-sea type fibers were dipped in a 10 mass % aqueous solution of sodium hydroxide, and the sea component of polylactic acid was extracted and removed by hydrolysis. Then, the product was air-dried to obtain bundled aggregates of the fine fibers A (a fiber diameter=2 μm; a fiber length=1 mm; adhesion rate of adhered substances=less than 0.02 mass %; sectional shape=circle, and islands-in-sea type) wherein high-density polyethylene and polypropylene were coexistent in each of the fine fibers. The resulting fine fibers A were drawn but not fibrillated. Each of fine fibers had substantially the same diameter in an axial direction thereof.

On the other hand, islands-in-sea type fibers (fineness=2 dtex) having 61 island components of crystalline polystyrene in a sea component of polyester copolymer were prepared by a composite spinning method, and cut to a fiber length of 0.5 mm. The resulting islands-in-sea type fibers were dipped in a 10 mass % aqueous solution of sodium hydroxide, and the sea component of polyester copolymer was extracted and removed by hydrolysis. Then, the product was air-dried to obtain bundled aggregates of the fine fibers B (a fiber diameter=1.1 μm; a fiber length=0.5 mm; adhesion rate of adhered substances=less than 0.02 mass %) of crystalline polystyrene. The resulting fine fibers B were drawn but fibrillated. Each of fine fibers had substantially the same diameter in an axial direction thereof.

Thereafter, the fine-fibers-dispersed nonwoven fabric of the present invention was produced by an apparatus similar to the manufacturing apparatus of the present invention as shown in FIG. 1. More particularly, the bundled aggregates of the fine fibers A and the bundled aggregates of the fine fibers B were charged into the mixer 10 at a mass ratio of 25:75, and loosened and mixed. The mixture of the aggregates of fine fibers was supplied to the nozzle 30 having an orifice with a continuously narrowing cross-sectional circular shape (diameter at an ejecting opening=3.2 mm), and at the same time, a compressed air (pressure=6 kg/cm$^2$) was introduced from the compressed-gas inlet 20 at an inside position near to the nozzle 30. The mixture of the aggregates of fine fibers 70 was ejected from the nozzle 30 (wherein a laminar flow was formed) to the air at the dispersing chamber 40 and the fine fibers 70 were dispersed in the dispersing chamber 40. The gas passing rate at the ejecting opening of the nozzle 30 was 1600 m/s.

Subsequently, the dispersed fine fibers 70 were collected on a nonwoven fabric substrate (a spun-bonded nonwoven fabric of polyester fibers; a mass per unit area=30 g/m$^2$; not shown) placed on the support 50 of a net, while the air was sucked at a suction rate of 2 m$^3$/min by a suction box 60 located under the support.

Then, the spun-bonded nonwoven fabric substrate carrying the dispersed fine fibers thereon was directly conveyed to an oven 90 at 130° C. and heated for 3 minutes, whereby the fine fibers were thermally fused to form a fine-fibers-dispersed nonwoven fabric layer by the high density polyethylene components in the high density polyethylene-polypropylene fine fibers, and the fine-fibers-dispersed nonwoven fabric layer and the spun-bonded nonwoven fabric substrate were also thermally fused to obtain a composite nonwoven fabric (mass per unit area=40 g/m$^2$; thickness=1.1 mm). The fine-fibers-dispersed nonwoven fabric layer had a mass per unit area of 10 g/m$^2$; thickness of 1 mm; and an apparent density of 0.01 g/cm$^3$. The adhesion rate of adhered substances, i.e., a percentage of total masses of the adhered substances extracted by dipping the fine-fibers-dispersed nonwoven fabric layer in hot water for 15 minutes and the adhered substances extracted by dipping the fine-fibers-dispersed nonwoven fabric layer in hot methanol for 15 minutes to a mass of the fine-fibers-dispersed nonwoven fabric layer, was less than 0.02 mass %.

Four sheets of the resulting composite nonwoven fabrics were superimposed, and HEPA filtering characteristics [wind velocity=5.3 cm/s; test particles=DOP (di-(2-ethylhexydyl) phthalate)] were examined. A capturing efficiency for particles of 0.3 μm was 99.98%, which satisfied a desired value of 99.97%, and a pressure loss was as low as 175 Pa, which satisfied a desired value of 400 Pa or less.

Comparative Example 1

The bundled aggregates of the fine fibers A and the bundled aggregates of the fine fibers B were prepared as in Example 1, and mixed at a mass ratio of 25:75, and then, a nonionic surface-active agent was added thereto at an amount of 10 mass % with respect to a total mass of the bundled aggregates of the fine fibers A and the bundled aggregates of the fine fibers B.

The resulting mixture was added to a slurry containing acrylamide as a sizing agent, and the aggregates of fine fibers were divided and dispersed by a mixer. The slurry was diluted to obtain a diluted slurry.

The diluted slurry was taken up on a nonwoven fabric substrate (a spun-bonded nonwoven fabric of polyester fibers; a mass per unit area=30 g/m$^2$) placed on the support of a net. Then, the spun-bonded nonwoven fabric substrate carrying the dispersed fine fibers thereon was conveyed to an oven at 130° C. and heated for 3 minutes whereby the fine fibers were thermally fused to form a fine-fibers-dispersed nonwoven fabric layer by the high density polyethylene components in the high density polyethylene-polypropylene fine fibers, and the fine-fibers-dispersed nonwoven fabric layer and the spun-bonded nonwoven fabric substrate were also thermally fused to obtain a composite nonwoven fabric (mass per unit area=50 g/m$^2$; thickness=0.3 mm). The fine-fibers-dispersed nonwoven fabric layer had a mass per unit area of 20 g/m$^2$; thickness of 0.2 mm; and an apparent density of 0.1 g/cm$^3$. The adhesion rate of adhered substances, i.e., a percentage of total masses of the adhered substances extracted by dipping the fine-fibers-dispersed nonwoven fabric layer in hot water for 15 minutes and the adhered substances extracted by dipping the fine-fibers-dispersed nonwoven fabric layer in hot methanol for 15 minutes to a mass of the fine-fibers-dispersed layer, was 1.5 mass %.

Two sheets of the resulting composite nonwoven fabrics were superimposed, and HEPA filtering characteristics [wind velocity=5.3 cm/s; test particles=DOP] were examined. A capturing efficiency for particles of 0.3 μm was 98%, which did not satisfy a desired value of 99.97%, and a pressure loss was 560 Pa higher than a desired value of 400 Pa or less. The fine-fibers dispersing nonwoven fabric layer was examined by an electron microscope and it was revealed that some parts of the bundled aggregates of the fine fibers A and B were not dispersed, and thus the bundled shape was maintained.

Example 2

The bundled aggregates of the fine fibers A prepared as in Example 1 and aggregates of polyester fine fibers (Teijin Ltd.; fineness=0.11 dtex; fiber diameter=3.2 μm; a fiber length=3 mm; adhesion rate of adhered substances=less than 0.02 mass %) which was washed with acetone to remove adhered substances (mainly a fiber auxiliary) were charged into the mixer at a mass ratio of 60:40, and loosened and mixed. The polyester fine fibers were drawn and not fibrillated. Each of polyester fine fibers had substantially same diameter in an axial direction thereof.

The mixture of the aggregates of the fine fibers was supplied to a cylindrical ejector having a cross-sectional circular shape at an ejecting opening (diameter=7 mm), and at the same time, a compressed air (pressure 6 kg/cm$^2$) was introduced from the compressed-gas inlet at an inside position near to the cylindrical ejector. The mixture of the aggregates of the fine fibers was ejected from the cylindrical ejector (wherein a spiral flow was formed) to the air at dispersing chamber and the fine fibers were generated and dispersed in the dispersing chamber. The gas passing rate at the ejecting opening of the cylindrical ejector was 160 m/s.

Subsequently, the dispersed fine fibers were collected on a nonwoven fabric substrate (a spun-bonded nonwoven fabric of polyester fibers; a mass per unit area=30 g/m$^2$) placed on the support of a net, while the air was sucked at a suction rate of 2 m$^3$/min by a suction box located under the support.

Then, the spun-bonded nonwoven fabric substrate carrying the dispersed fine fibers thereon was directly conveyed to an oven at 130° C. and heated for 3 minutes whereby the fine fibers were thermally fused to form a fine-fibers-dispersed nonwoven fabric layer by the high density polyethylene components in the high density polyethylene-polypropylene fine fibers, and the fine-fibers-dispersed nonwoven fabric layer and the spun-bonded nonwoven fabric substrate were also thermally fused to obtain a composite nonwoven fabric (mass per unit area=50 g/m$^2$; thickness=3 mm). The fine-fibers-dispersed nonwoven fabric layer had a mass per unit area of 20 g/m$^2$; thickness of 2.9 mm; and an apparent density of 0.007 g/cm$^3$. The adhesion rate of adhered substances, i.e., a percentage of total masses of the adhered substances extracted by dipping the fine-fibers-dispersed nonwoven fabric layer in hot water for 15 minutes and the adhered substances extracted by dipping the fine-fibers-dispersed nonwoven fabric layer in hot methanol for 15 minutes to a mass of the fine-fibers-dispersed layer, was less than 0.02 mass %.

The composite nonwoven fabric contained the fine-fibers-dispersed nonwoven fabric layer, and thus, exhibited excellent filtering characteristics and pliability.

Example 3

Islands-in-sea type fibers (fineness=8.8 dtex) having about 3900 island components of poly-4-methylpentene in a sea component of polyester copolymer were prepared by a melt blend spinning method, and cut to a fiber length of 0.5 mm. The resulting islands-in-sea type fibers were dipped in a 10 mass % aqueous solution of sodium hydroxide, and the sea component of polyester copolymer was extracted and removed by hydrolysis. Then, the product was air-dried to obtain bundled aggregates of the fine fibers C (a fiber diameter=0.4 μm; a fiber length=0.5 mm; adhesion rate of adhered substances=less than 0.02 mass %) of poly-4-methylpentene. The resulting fine fibers C were drawn but not fibrillated.

Further, the bundled aggregates of the fine fibers A were prepared as in Example 1.

Thereafter, the bundled aggregates of the fine fibers A and the bundled aggregates of the fine fibers C were charged into the mixer at a mass ratio of 50:50, and loosened and mixed. The mixture of the aggregates of the fine fibers was supplied to a Venturi tube having a cross-sectional circular shape at an ejecting opening (diameter=8.5 mm) and a cross-sectional circular shape at a fibers-supplying side (diameter=3 mm), and a compressed air (pressure=6 kg/cm$^2$) was introduced from the compressed-gas inlet at an inside position near to the Venturi tube. The mixture of the aggregates of the fine fibers was ejected from the Venturi tube (wherein a laminar flow was formed) to the air at dispersing chamber and the aggregates of the fine fibers were brought into collision with a baffle plate placed in front of the Venturi tube and dispersed. The distance between the baffle plate and the ejecting opening of the Venturi tube was 15 mm. The gas passing rate at the ejecting opening of the Venturi tube was 118 m/s.

Subsequently, the dispersed fine fibers were collected on a nonwoven fabric substrate (a spun-bonded nonwoven fabric of polyester fibers; a mass per unit area=30 g/m$^2$) placed on the support of a net, while the air was sucked at a suction rate of 2 m$^3$/min by a suction box located under the support.

Then, the spun-bonded nonwoven fabric substrate carrying the dispersed fine fibers thereon was directly conveyed to an oven at 130° C. and heated for 3 minutes, whereby the fine fibers were thermally fused to form a fine-fibers-dispersed nonwoven fabric layer by the high density polyethylene components in the high density polyethylene-polypropylene fine fibers, and the fine-fibers-dispersed nonwoven fabric layer and the spun-bonded nonwoven fabric substrate were also thermally fused to obtain a composite nonwoven fabric (mass per unit area=40 g/m$^2$; thickness=0.9 mm). The fine-fibers-dispersed nonwoven fabric layer had a mass per unit area of 10 g/m$^2$; thickness of 0.8 mm; and an apparent density of 0.013 g/cm$^3$. The adhesion rate of adhered substances, i.e., a percentage of total masses of the adhered substances extracted by dipping the fine-fibers-dispersed layer in hot water for 15 minutes and the adhered substances extracted by dipping the fine-fibers-dispersed layer in hot methanol for 15 minutes to a mass of the fine-fibers-dispersed layer, was less than 0.02 mass %.

The composite nonwoven fabric contained the fine-fibers-dispersed nonwoven fabric layer, and thus, exhibited excellent filtering characteristics and pliability.

Example 4

The bundled aggregates of the fine fibers A were prepared as in Example 1, and the bundled aggregates of the fine fibers C were prepared as in Example 3.

Thereafter, the bundled aggregates of the fine fibers A and the bundled aggregates of the fine fibers C were charged into the mixer at a mass ratio of 5:95, and loosened and mixed. The mixture of the aggregates of the fine fibers was supplied to a Venturi tube with a truncated cone shape having a cross-sectional circular shape at an ejecting opening (diameter=8.5 mm) and a cross-sectional circular shape at a fibers-supplying side (diameter=3 mm), and a compressed air (pressure=6 kg/cm$^2$) was introduced from the compressed-gas inlet at an inside position near to the Venturi tube. The mixture of the aggregates of the fine fibers was ejected from the Venturi tube (wherein a laminar flow was formed) to the air at dispersing chamber and the fine fibers were brought into collision with a baffle plate placed in front of the Venturi tube, and dispersed. The distance between the baffle plate and the ejecting opening of the Venturi tube was 15 mm. The gas passing rate at the ejecting opening of the Venturi was 118 m/s.

Subsequently, the dispersed fine fibers were collected on a nonwoven fabric substrate (a spun-bonded nonwoven fabric of polyester fibers; a mass per unit area=30 g/m$^2$) placed on the support of a net, while the air was sucked at a suction rate of 2 m$^3$/min by a suction box located under the support.

Then, the spun-bonded nonwoven fabric substrate carrying the dispersed fine fibers thereon was conveyed to an oven at 130° C. and heated for 3 minutes, whereby the fine fibers were thermally fused to form a fine-fibers-dispersed nonwoven fabric layer by the high density polyethylene components in the high density polyethylene-polypropylene fine fibers, and the fine-fibers-dispersed nonwoven fabric layer and the spun-bonded nonwoven fabric substrate were also thermally fused to obtain a composite nonwoven fabric (mass per unit area=40 g/m$^2$; thickness=0.8 mm). The fine-fibers-dispersed nonwoven fabric layer had a mass per unit area of 10 g/m$^2$; thickness of 0.7 mm; and an apparent density of 0.014 g/cm$^3$.

The adhesion rate of adhered substances, i.e., a percentage of total masses of the adhered substances extracted by dipping the fine-fibers-dispersed layer in hot water for 15 minutes and the adhered substances extracted by dipping the fine-fibers-dispersed layer in hot methanol for 15 minutes to a mass of the fine-fibers-dispersed layer, was less than 0.02 mass %.

The composite nonwoven fabric contained the layer of dispersed fine fibers with submicron, and thus, exhibited very excellent filtering characteristics and pliability.

Figure 2:
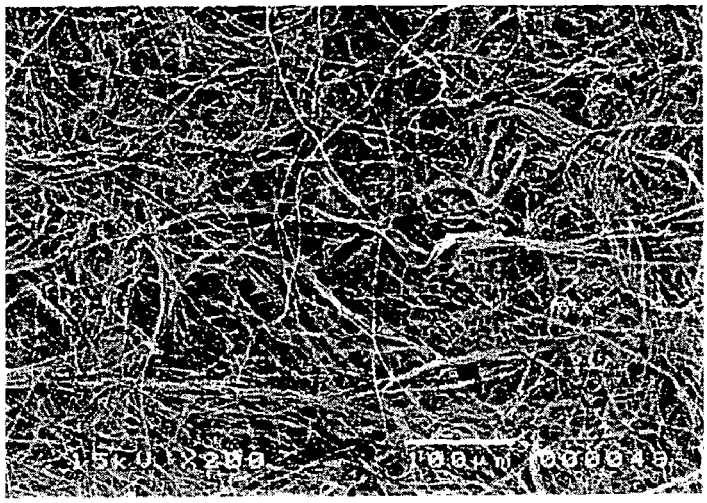
FIG. 2 is an electron microscope photograph of the surface of the fine-fibers-dispersed nonwoven fabric layer in the composite nonwoven fabric prepared in Example 4.

FIG. 2 is an electron micrograph of the surface of the fine-fibers dispersing nonwoven fabric layer. As apparent from FIG. 2, the bundled aggregates of the fibe fibers were divided into the fine fibers and the fine fibers were uniformly dispersed.

Comparative Example 2

The bundled aggregates of the fine fibers A were prepared as in Example 1, and the bundled aggregates of the fine fibers C were prepared as in Example 3.

Then, potassium lauryl phosphate (Takemoto Yushi) as a fiber auxiliary was added at an amount of 0.6 mass % with respect to a total mass of the bundled aggregates of the fine fibers A and the bundled aggregates of the fine fibers C.

Subsequently, the procedure described in Example 4 was repeated, using the same composition of the fibers as in Example 4, whereby the fine fibers were thermally fused to form a fine-fibers-dispersed nonwoven fabric layer by the high density polyethylene components in the high density polyethylene-polypropylene fine fibers, and the fine-fibers-dispersed nonwoven fabric layer and the spun-bonded nonwoven fabric substrate were also thermally fused to obtain a composite nonwoven fabric (mass per unit area=40 g/m$^2$; thickness=0.8 mm). The fine-fibers-dispersed nonwoven fabric layer had a mass per unit area of 10 g/m$^2$; thickness of 0.7 mm; and an apparent density of 0.014 g/cm$^3$. The adhesion rate of adhered substances, i.e., a percentage of total masses of the adhered substances extracted by dipping the fine-fibers-dispersed layer in hot water for 15 minutes and the adhered substances extracted by dipping the fine-fibers-dispersed layer in hot methanol for 15 minutes to a mass of the fine-fibers-dispersed layer, was 0.6 mass %.

Figure 3:
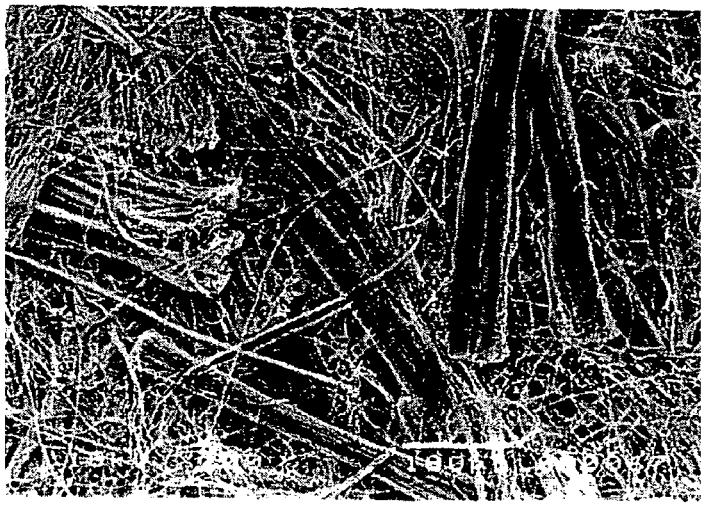
FIG. 3 is an electron microscope photograph of the surface of the fine-fibers-dispersed nonwoven fabric layer in the composite nonwoven fabric prepared in Comparative Example 2.

FIG. 3 is an electron micrograph of the surface of the fine-fibers dispersing nonwoven fabric layer. As apparent from FIG. 3, some parts of the bundled aggregates of the fine fibers A, C were not divided, and the bundled shapes remained.

Example 5

The bundled aggregates of the fine fibers A were prepared as in Example 1, and the bundled aggregates of the fine fibers C were prepared as in Example 3.

Thereafter, the bundled aggregates of the fine fibers A and the bundled aggregates of the fine fibers C were charged into the mixer at a mass ratio of 25:75, and loosened and mixed.

Subsequently, the procedure described in Example 2 was repeated, whereby the fine fibers were thermally fused to form a fine-fibers-dispersed nonwoven fabric layer by the high density polyethylene components in the high density polyethylene-polypropylene fine fibers, and the fine-fibers-dispersed nonwoven fabric layer and the spun-bonded nonwoven fabric substrate were also thermally fused to obtain a composite nonwoven fabric (mass per unit area=40 g/m$^2$; thickness=0.8 mm). The fine-fibers-dispersed layer had a mass per unit area of 10 g/m$^2$; thickness of 0.7 mm; and an apparent density of 0.014 g/cm$^3$. The adhesion rate of adhered substances, i.e., a percentage of total masses of the adhered substances extracted by dipping the fine-fibers-dispersed layer in hot water for 15 minutes and the adhered substances extracted by dipping the fine-fibers-dispersed layer in hot methanol for 15 minutes to a mass of the fine-fibers-dispersed layer, was less than 0.02 mass %.

The composite nonwoven fabric contained the layer of dispersed fine fibers with submicron, and thus, exhibited excellent filtering characteristics and pliability.

Figure 4:
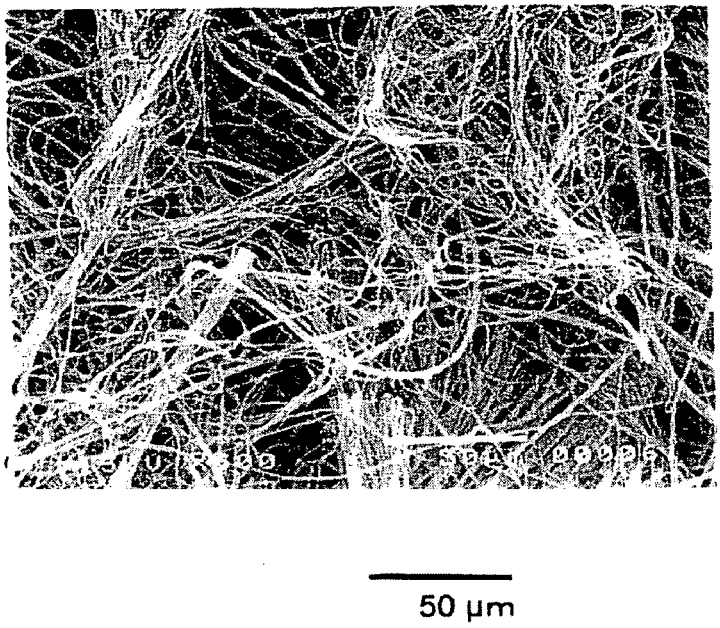
FIG. 4 is an electron microscope photograph of the surface of the fine-fibers-dispersed nonwoven fabric layer in the composite nonwoven fabric prepared in Example 5.

FIG. 4 is an electron micrograph of the surface of the fine-fibers dispersing nonwoven fabric layer. As apparent from FIG. 4, although a few bundled aggregates were not completely divided into the fine fibers, almost all of the bundled aggregates were divided into the fine fibers, and the fine fibers were uniformly dispersed.

Example 6

The bundled aggregates of the fine fibers A were prepared as in Example 1, and the bundled aggregates of the fine fibers C were prepared as in Example 3.

Thereafter, the bundled aggregates of the fine fibers A and the bundled aggregates of the fine fibers C were charged into the mixer at a mass ratio of 25:75, and loosened and mixed.

Subsequently, the procedure described in Example 4 was repeated, whereby the fine fibers were thermally fused to form a fine-fibers-dispersed nonwoven fabric layer by the high density polyethylene components in the high density polyethylene-polypropylene fine fibers, and the fine-fibers-dispersed nonwoven fabric layer and the spun-bonded nonwoven fabric substrate were also thermally fused to obtain a composite nonwoven fabric (mass per unit area=40 g/m$^2$; thickness=0.8 mm). The fine-fibers-dispersed nonwoven fabric layer had a mass per unit area of 10 g/m$^2$; thickness of 0.7 mm; and an apparent density of 0.014 g/cm$^3$. The adhesion rate of adhered substances, i.e., a percentage of total masses of the adhered substances extracted by dipping the fine-fibers-dispersed layer in hot water for 15 minutes and the adhered substances extracted by dipping the fine-fibers-dispersed layer in hot methanol for 15 minutes, to a mass of the fine-fibers-dispersed layer, was less than 0.02 mass %.

The composite nonwoven fabric contained the layer of dispersed submicron fine fibers, and thus, exhibited very excellent filtering characteristics and pliability.

Figure 5:
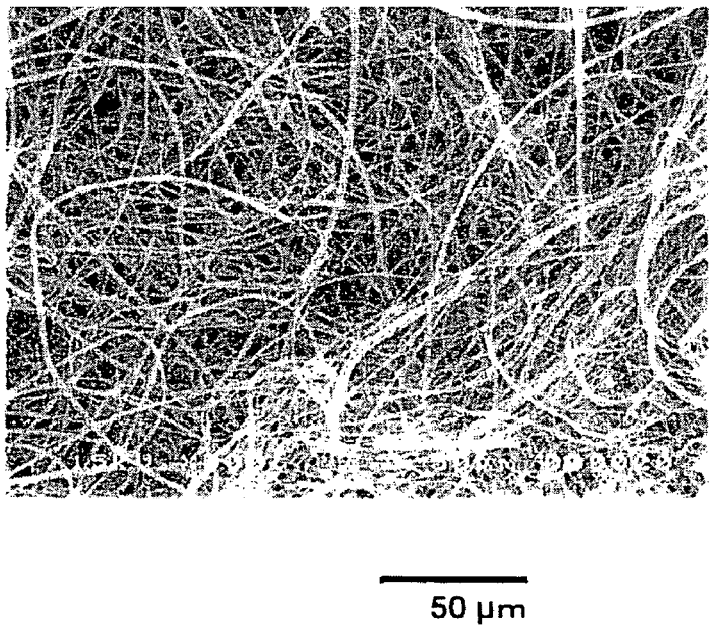
FIG. 5 is an electron microscope photograph of the surface of the fine-fibers-dispersed nonwoven fabric layer in the composite nonwoven fabric prepared in Example 6.

FIG. 5 is an electron micrograph of the surface of the fine-fibers dispersing nonwoven fabric layer. As apparent from FIG. 5, the bundled aggregates were completely divided into the fine fibers, and the fine fibers were uniformly dispersed.

As explained, the fine-fibers-dispersed nonwoven fabric of the present invention includes a very small amount of adhered substances, such as the surface-active agents or sizing agents, and thus, the degree of adhesion of the fine fibers is at a lower level. Therefore, the fine-fibers-dispersed nonwoven fabric contains an appropriate amount of voids having an appropriate size, and a pressure loss of the fine-fibers-dispersed nonwoven fabric is small. Further, in the fine-fibers-dispersed nonwoven fabric of the present invention, the fine fibers are not present in the form of bundles but in the dispersed state, and thus, the fine-fibers-dispersed nonwoven fabric has excellent properties, such as filtering characteristics and a pliability, due to the containing of the fine fibers.

In the process of the present invention, a medium (such as a solvent) used for dispersing the fine fibers in the conventional process is not required, but the fine fibers are dispersed into a gas, and thus, it is not necessary to use the surface-active agents or sizing agents required in the process using a solvent as a dispersing medium. Therefore, according to the process of the present invention, the nonwoven fabric wherein an adhesion rate of the substances adhered to the fine-fibers-dispersed nonwoven fabric layer is 0.5 mass % or less, i.e., the nonwoven fabric containing the fine fibers adhered to each other to a lesser degree, can be easily prepared.

Further, the nonwoven fabric containing the uniformly dispersed fine fibers can be easily prepared, because the fine-fibers-dispersed nonwoven fabric is prepared by ejecting the fine-fibers aggregates or the group thereof, and/or the mechanically dividable fibers or the aggregates thereof, from the nozzle into the gas by an action of the compressed gas.

As above, the present invention was explained with reference to particular embodiments, but modifications and improvements obvious to those skilled in the art are included in the scope of the present invention.

The invention claimed is:

1. A process for manufacturing a fine-fibers-dispersed nonwoven fabric comprising the steps of:

ejecting bundled aggregates of fine fibers having a fiber diameter of 4 μm or less and a fiber length of 3 mm or less and made of an organic material prepared by removing a sea component from islands-in-sea type fibers, or a group of the aggregates, from a Venturi tube into a gas by an action of a compressed gas having a pressure of 2 $kg/cm^2$ or more and introduced from an inlet located upstream from and near the Venturi tube, and bringing the bundled aggregates of fine fibers or the group thereof, into collision with a flat region of a colliding means placed in front of an ejecting opening of the Venturi tube, to thereby divide the bundled aggregates or the group thereof into the fine fibers, and disperse the resulting fine fibers;

collecting the dispersed fine fibers to form a fiber web; and bonding the fiber web to obtain the fine-fibers-dispersed nonwoven fabric.

2. The process according to claim 1, wherein, in addition to the bundled fine-fibers aggregates or the group thereof, other fibers or the aggregates thereof are ejected from the Venturi tube.

3. The process according to claim 1, wherein before supplying the bundled fine-fibers aggregates or the group thereof to the Venturi tube, adhered substances are removed from the bundled fine-fibers aggregates or the group thereof.

4. The process according to claim 1, wherein a gas stream passing through the Venturi tube is substantially a laminar flow.

5. A process for manufacturing a sheet material comprising the steps of:

ejecting bundled aggregates of fine fibers having a fiber diameter of 4 μm or less and a fiber length of 3 mm or less and made of an organic material prepared by removing a sea component from islands-in-sea type fibers, or a group of the aggregates, from a Venturi tube into a gas by an action of a compressed gas having a pressure of 2 $kg/cm^2$ or more and introduced from an inlet located upstream from and near the Venturi tube, and bringing the bundled aggregates of fine fibers or the group thereof into collision with a flat region of a colliding means placed in front of an ejection opening of the Venturi tube, to thereby divide the bundled aggregates or the group thereof into the fine fibers, and disperse the resulting fine fibers;

collecting the dispersed fine fibers on a reinforcing substrate to form a fiber web on the reinforcing substrate; and bonding the fiber web, and the fiber web and the reinforcing substrate to obtain the sheet material comprising the fine-fibers-dispersed nonwoven fabric layer and the reinforcing layer.

6. The process according to claim 5, wherein, in addition to the bundled fine-fibers aggregates or the group thereof, other fibers or the aggregates thereof are ejected from the Venturi tube.

7. The process according to claim 5, wherein before supplying the bundled fine-fibers aggregates or the group thereof to the Venturi tube, adhered substances are removed from the bundled fine-fibers aggregates or the group thereof.

8. The process according to claim 5, wherein a gas stream passing through the Venturi tube is substantially a laminar flow.

* * * * *